US010618693B2

(12) United States Patent
Hanna

(10) Patent No.: US 10,618,693 B2
(45) Date of Patent: Apr. 14, 2020

(54) SELF-STANDING FOOD CONTAINER

(71) Applicant: Sonoco Plastics, Inc., Hartsville, SC (US)

(72) Inventor: Roger Hanna, Plant City, FL (US)

(73) Assignee: Sonoco Plastics, Inc., Hartsville, SC (US)

( * ) Notice: Subject to any disclaimer, the term of this patent is extended or adjusted under 35 U.S.C. 154(b) by 0 days.

(21) Appl. No.: 15/615,509

(22) Filed: Jun. 6, 2017

(65) Prior Publication Data

US 2018/0346193 A1 Dec. 6, 2018

(51) Int. Cl.

*B65D 43/16* (2006.01)
*B65D 21/02* (2006.01)
*B65D 25/00* (2006.01)

(52) U.S. Cl.

CPC ..... *B65D 21/0233* (2013.01); *B65D 25/00* (2013.01); *B65D 43/162* (2013.01); *B65D 21/0223* (2013.01); *B65D 2543/0012* (2013.01); *B65D 2543/0062* (2013.01); *B65D 2543/00296* (2013.01); *B65D 2543/00351* (2013.01); *B65D 2543/00518* (2013.01); *B65D 2543/00537* (2013.01); *B65D 2543/00555* (2013.01); *B65D 2543/00685* (2013.01); *B65D 2543/00731* (2013.01); *B65D 2543/00796* (2013.01)

(58) Field of Classification Search

CPC ..... B65D 21/0217; B65D 21/0201; B65D 21/0202; B65D 21/00; B65D 5/00; B65D 5/42; B65D 43/00; B65D 43/162

USPC .... 220/4.21, 4.22, 4.24, 500, 520, 523, 526, 220/553, 660, 669, 810

See application file for complete search history.

(56) References Cited

U.S. PATENT DOCUMENTS

| | | | | |
|---|---|---|---|---|
| 4,962,849 | A | 10/1990 | Anderson | |
| 5,011,006 | A | 4/1991 | Anderson | |
| 7,624,859 | B1 | 12/2009 | Casanova et al. | |
| 8,158,174 | B2 | 4/2012 | Castellanos et al. | |
| 8,261,933 | B2 * | 9/2012 | Kidd | B65D 75/22 220/324 |
| 8,763,806 | B2 | 7/2014 | Ludwig | |
| 8,857,610 | B1 | 10/2014 | Gruber | |
| 2007/0092611 | A1 | 4/2007 | Hinze et al. | |
| 2008/0128424 | A1 * | 6/2008 | Castellanos | B65D 1/34 220/500 |
| 2014/0174973 | A1 | 6/2014 | Bailey | |
| 2016/0023815 | A1 * | 1/2016 | Siskindovich | B65D 43/0254 220/270 |

* cited by examiner

*Primary Examiner* — Andrew T Kirsch
*Assistant Examiner* — Elizabeth J Volz
(74) *Attorney, Agent, or Firm* — Fish & Richardson P.C.

(57) ABSTRACT

A container has a base flange on a base, and a lid flange on a lid. When the container is in a closed position the lid flange and the base flange are in juxtaposition and one of the flange edges defines a flange support surface. A lid surface is spaced above an upper base periphery when in the closed position to define a lid volume, and the base section defines a base volume. The flange support surface extends a first distance such that when the volume of the container is loaded with a rated capacity of product and the container is placed in a standing position on a flat surface using the flange support surface and a front base corner as support elements, a center of gravity of the container generates a moment about an axis of the base corner that biases the container in the standing position.

13 Claims, 6 Drawing Sheets

SELF-STANDING FOOD CONTAINER

BACKGROUND

Many food products are stored and shipped in lightweight plastic containers. Typically, a plastic container is constructed to facilitate automated packaging of the food products. The containers are typically designed to be shipped from a manufacturer in a stacked arrangement.

Because the container is intended to be used for shipping and display after packaging, it is desirable that the container, in some situations, be placed in a vertical or angled standing position. This is because the top surface of the container has a larger area than a side surface, and thus any branding materials applied to the container will have a larger display area. Some containers are designed to be placed in shelf display stand that is cooperatively shaped to receive a container and maintain the container in a vertically biased position. Other containers have base potions defining shaped volumes that taper to a reduced cross-sectional area near the top of the container when the container is placed in the vertical position so that a center of gravity of the container is position to bias the container in the vertical position. Still other containers have specially designed support structures that are separate from peripheral flanges and that support the container in a standing position.

SUMMARY

This specification describes technologies relating a container, such as a food container, that may be vertically biased in a standing position when filled to a capacity of product. As used in this description, the term "vertically biased" means that a container is positioned such that the bottom surface of the container is displayed from a flat surface on which the container is rested by at least an acute angle and tends to remain in this position. As such, a top surface of a lid of the container is prominently displayed.

In general, one innovative aspect of the subject matter described in this specification can be embodied in a container apparatus that includes: a base section, comprising a base surface defining a base plane, base sidewalls extending upward from the base surface to define a base container portion having an upper base periphery, wherein one of the base sidewalls is a front base sidewall, and the front base sidewall extends upward from the base surface to define a base corner on the exterior of the base section, and a base flange projecting outward relative to at least the front base sidewall; a lid section, comprising a lid surface defining a lid plane, lid sidewalls extending downward from the lid surface to define a lid container portion having a downward lid periphery, wherein one of the lid sidewalls is a front lid sidewall, and a lid flange projecting outward relative to at least the front lid sidewall. When in a closed position, the lid flange and the base flange are in juxtaposition and at least one of an outer edge of the base flange or an outer edge of the lid flange defines a flange support surface; the lid surface is spaced above upper base periphery when in the closed position to define a lid volume from the upper base periphery to the lid surface, and the base section defines a base volume from the upper base periphery to the base surface; and the flange support surface extends outwardly a first distance such that when the combined lid volume and the base volume is loaded with a rated capacity of product and the container apparatus is placed in a standing position on a flat surface using the flange support surface and the base corner as respective support elements, a resulting center of gravity of the container apparatus generates a moment about an axis of the base corner that biases the container apparatus in the standing position.

Particular embodiments of the subject matter described in this specification can be implemented so as to realize one or more of the following advantages. The container, by having the lid volume in addition to the base volume, has a center of gravity that causes the container to remain in the vertically biased position. This eliminates the need for a specially designed receiving stand, which reduces production costs and does not impede salability of the container to food manufactures. Moreover, the lid volume eliminates the need for the base volume to taper asymmetrically from the front side surface nearest a flat surface on which the container rest to a back side surface that is opposite the front side surface. This allows for a more efficient volume usage for any given set of outer cubic dimensions, i.e., a cubic region in which the container fits, that can receive the container. Finally, because the container uses one or both of an outer edge of a lid flange and base flange in combination with a front bottom corner of the container as support surfaces, the container need not have other attachments or integrally formed features to support the container in the vertical position. This reduces production costs and facilitates stacking of the container for shipment and for use in food packing processing equipment.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. Reference numerals in drawings subsequent to the drawings in which they are introduced may be omitted to avoid congestion in the drawings.

DETAILED DESCRIPTION

Figure 1:
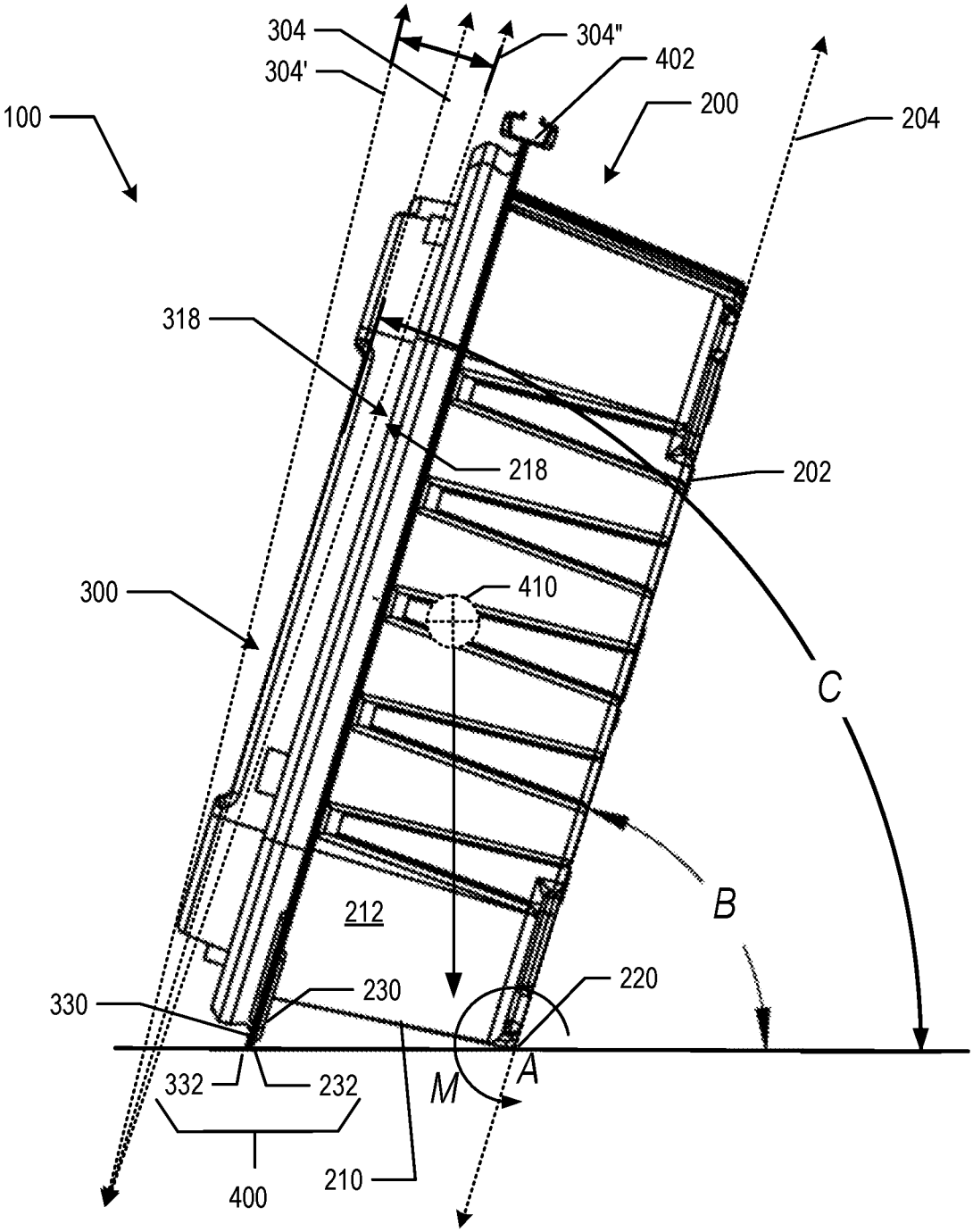
FIG. 1 is a side view of the container standing in a vertically biased position.

With reference to FIG. 1, a container 100 has a base flange 230 on a base 200, and a lid flange 330 on a lid 300. When the container 100 is in a closed position as shown in FIG. 1, the lid flange 330 and the base flange 230 are in juxtaposition and one (or both) of the flange edges 332 and 232 defines a flange support surface 400. A lid surface 302 is spaced above an upper base periphery 218 when in the closed position to define a lid volume, and the base section 200 defines a base volume relative to the upper base periphery 218. The flange support surface 400 extends a first distance from a front base 210 such that when the volume of the container 100, which is the sum of the lid volume and the base volume, is loaded with a rated capacity of product, and the container 100 is placed in a standing position on a flat surface 102 using the flange support surface 400 and a front base corner 220 as support elements, a center of gravity 410 of the container 100 generates a moment M about an axis A of the base corner 200 that biases the container 100 in the standing position.

These features and additional features are describe in more detail below.

Referring generally to Figures, the container apparatus 100 includes a based section 200 and a lid section 300. The base section and lid section may be flexibly connected to each other, such as by a living hinge 402. Other hinge connections may also be used.

The base section 200 includes a base surface 202 defining a base plane 204, and base sidewalls 210, 212, 214 and 216 extending upward from the base surface 202 to define a base container portion having an upper base periphery 218. The volume within the base sidewalls 210, 212, 214 and 216 and base surface 204 to the upper base periphery 218 is referred to as the base volume. The base sidewall 210 is a front base sidewall 210, and the front base sidewall 210 extends upward from the base surface 202 to define a base corner 220 on the exterior of the base section 200. It is on this base corner 220 that the container apparatus 100 rests when in the vertical position. The base section also includes a base flange 230 projecting outward relative to the front base sidewall 210.

The lid section 300 has a lid surface 302 defining a lid plane 304, and lid sidewalls 310, 312, 314 and 316 extending downward from the lid surface 302 to define a lid container portion having a downward lid periphery 318. The volume within the lid sidewalls 310, 312, 314 and 316 and lid surface 302 to the downward lid periphery 318 is referred to as the lid volume. The lid sidewall 310 is a front lid sidewall 310, and a lid flange 330 projects outward relative to front lid sidewall 310.

Figure 2:
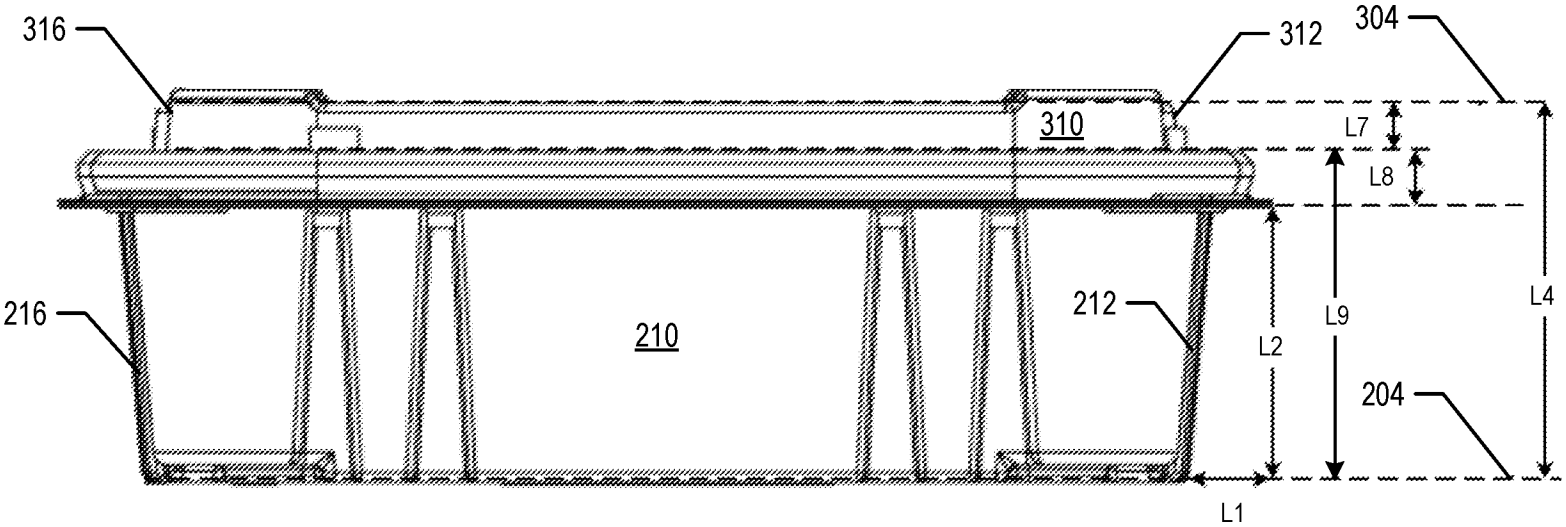
FIG. 2 is a front view of the container in a closed position.
Figure 3A:
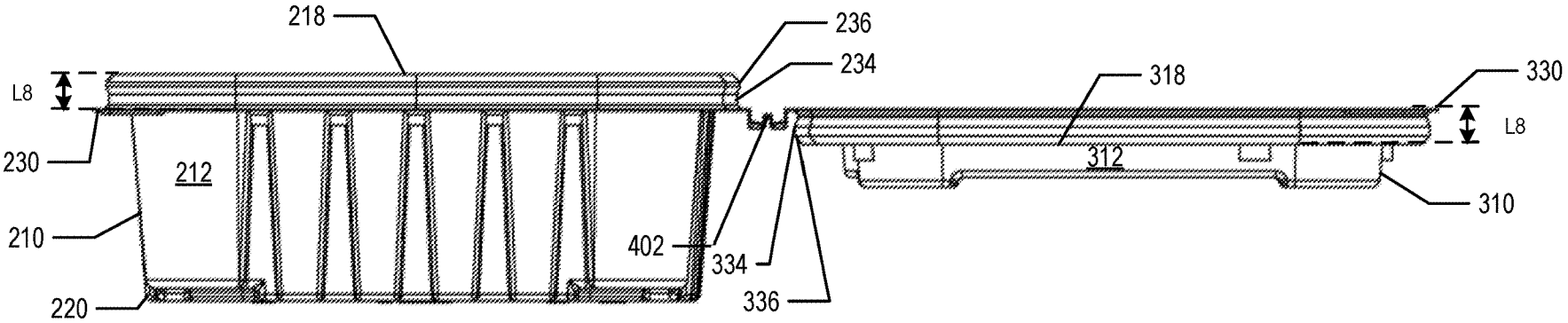
FIG. 3A is a side view of the container in an open position.
Figure 6:
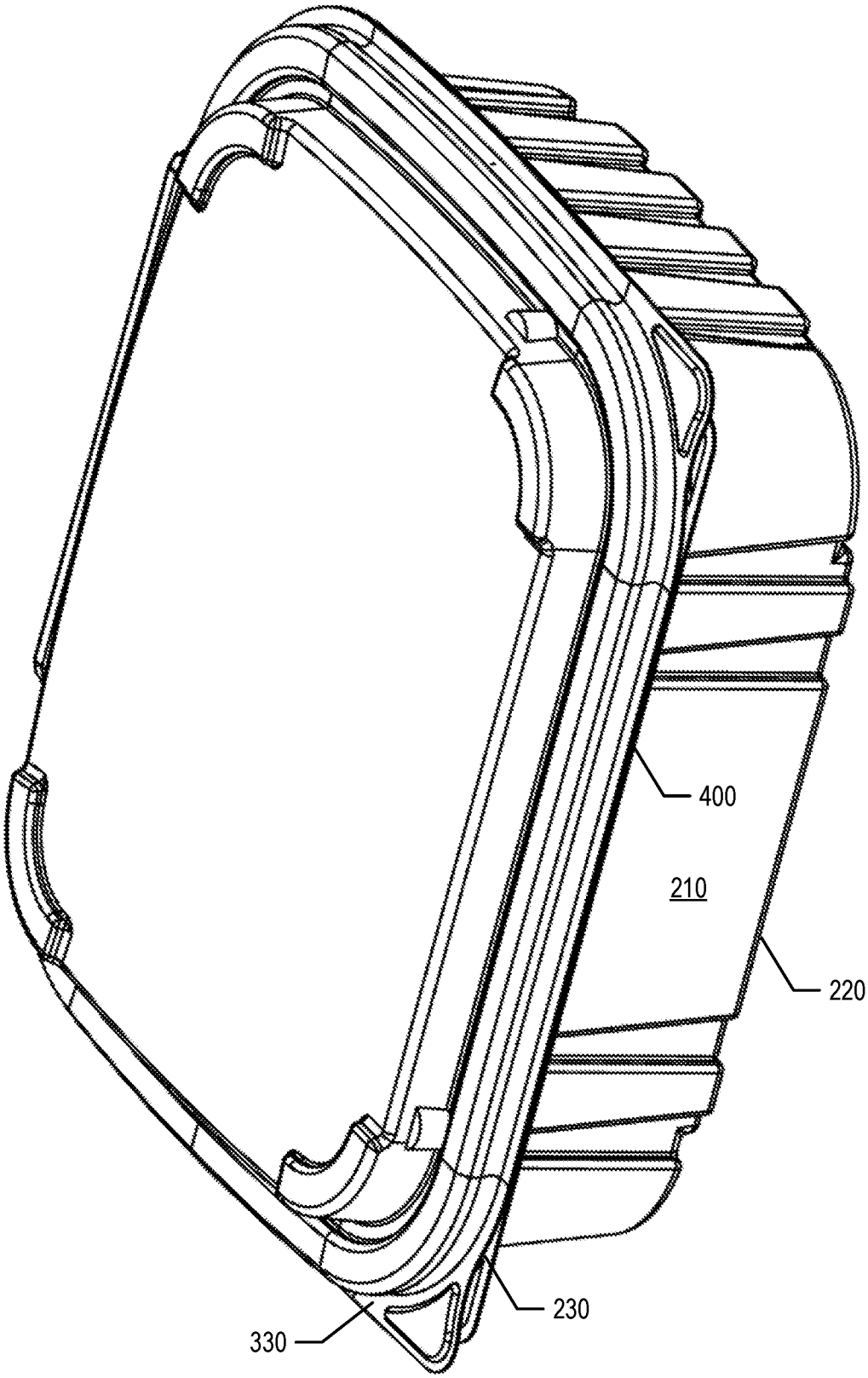
FIG. 6 is a top perspective view of the container in the closed position.

As illustrated in FIGS. 1, 2 and 6, the upper base periphery 218 is juxtaposed the downward lid periphery 318 when the container is in the closed position. Furthermore, as shown in FIG. 3A, the upper base periphery 218 defines a topmost surface of the base portion 200 and is above the base flange 230, while the downward lid periphery 318 is below the lid flange 330. Moreover, in the closed position the lid flange 330 and the base flange 230 are in juxtaposition and at least one of an outer edge 232 of the base flange 230 or an outer edge 332 of the lid flange 330 (or both outer edges 232 and 332) defines a flange support surface 400.

As shown in FIG. 2, the flange support surface 400 extends outwardly a first distance L1 relative to the base corner 220. Combined with the vertical distance L2, the container rests at an angle B when stood on its front side, as shown in FIG. 1. When the combined lid volume and the base volume is loaded with a rated capacity of product and the container apparatus 100 is placed in a standing position on a flat surface 102 using the flange support surface 400 and the base corner 220 as respective support elements, a resulting center of gravity 410 of the container apparatus 100 generates a moment M about an axis A of the base corner 220 that biases the container apparatus 100 in the standing position.

Figure 4:
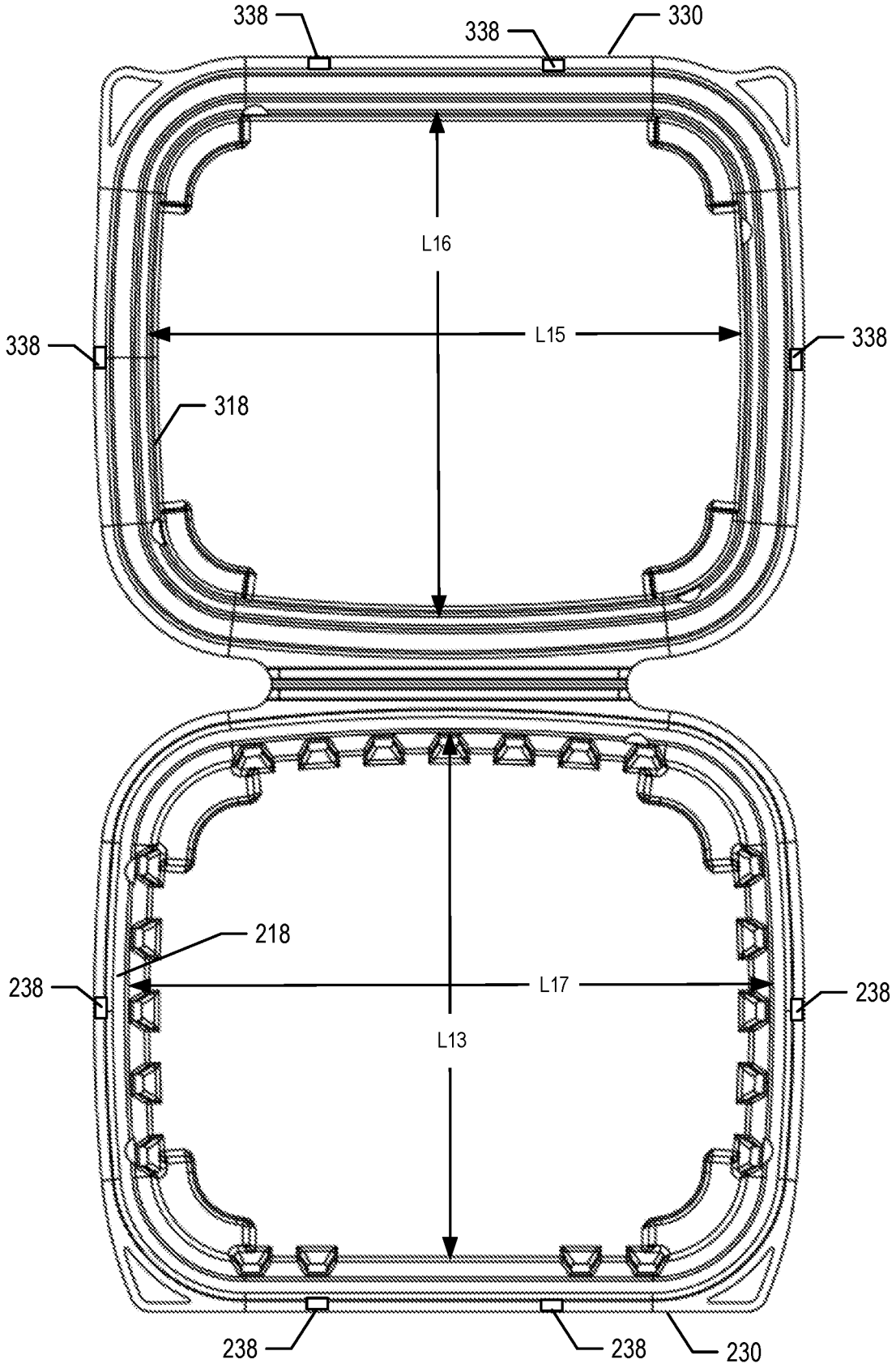
FIG. 4 is a top view of the container in an open position.
Figure 5:
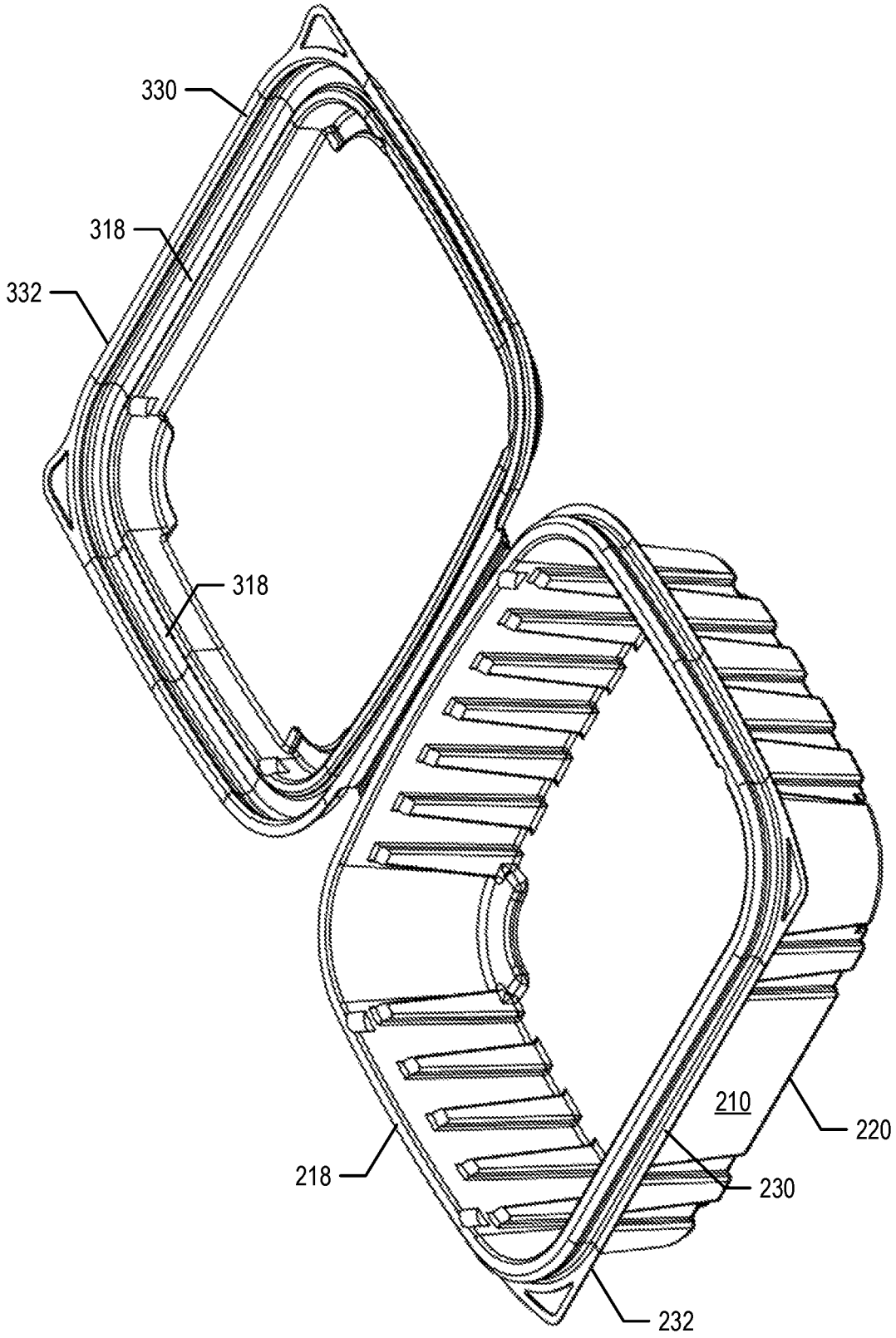
FIG. 5 is a top perspective view of the container in the open position.

The distances L, as reference in FIG. 2 and FIG. 4, may be selected such that the lid volume relative to the base volume, when the container 100 is resting in the vertical position, is sufficient to cause the center of gravity the moment M about the axis A to bias the container 100 in the upright standing position.

In the example implementation shown, the base flange 230 and lid flange 330 project outward relative to the front base sidewall 210 and at a position this is below the upper base periphery 218 by a distance L8. The distance L7, which separates the downward lip periphery 318 from the lid surface 300, when combined with the inner width L15 and inner depth L16 of the downward lid periphery 318, substantially defines the lid volume. Likewise, the distance L9, which separates the upper base periphery 218 from the base surface 202, when combined with the inner width L13 and inner depth L17 of the upper base periphery 218, substantially defines the lid volume.

In the example implementation shown in FIGS. 2 and 4, a first ratio of a height L4 measured from the base surface 202 to the lid surface 302, to a width L13 measured from an interior of the upper base periphery 218 of the front base sidewall 210 to an interior of the upper base periphery 218 of the back base sidewall 214, is approximately 1:2.4. A second ratio of a height L7 measured from the upper base periphery 218 to the lid surface 302 to a second height L9 measured from the base surface 202 the upper base periphery 218 is approximately 1:6.7. These examples are illustrative only, and other dimensions may be used so long as the combined lid volume and based volume result in the positioning of the center of gravity as described above.

The resting angel B can be selected, in part, on the position of the center of gravity 410. As shown in FIGS. 1 and 2, the flange support surface 400 extends outward to a distance L1 that causes the container apparatus 100 to rest in the standing position at a first angle B in the range of 70 degrees to 75 degrees measure from the base plane 204 to the flat surface 102.

In some implementations, the lid plane 304 is parallel to the base plane 204, and thus the angel C of the lid plane relative to the surface 102 is the same as B. However, in some implementations, the lid portion 300 can be shaped so the lid surface 302 is not parallel to the base surface 202, such that the angle of the lid plane 304 may vary, as indicated by alternate lid planes 304' and 304". Note that the lid plane 304' will cause the center of gravity 410 to move toward the lid portion 300, while the lid plane 304" will cause the center of gravity 410 to move toward the base portion.

When the container apparatus 100 is in the closed position with the lid plane 304', the second angle C is greater than the first angle B. Conversely, the container apparatus 100 is in the closed position with the lid plane 304", the second angle C is less than the first angle B.

As described above, the base flange 230 is below the upper base periphery 218, and the lid flange 330 is below the downward lid periphery 318. These vertical dispositions are, in some implementations, achieved by use of displacement flanges. For example, as shown in FIG. 2, a base displacement flange 234 extends downward from the upper base periphery 218. The base displacement flange 234, in some implementations, runs the entire periphery of the upper base periphery 218. Likewise, a lid displacement flange 334 extends downward from the downward lip periphery 318 and, in some implementations, runs the entire periphery of the downward lip periphery 318.

In some implementations, the lid displacement flange 334 and the base displacement flange 234 include respective integrally formed and cooperatively placed locking components 336 and 236 so that the lid section 300 and the base section 200 interlock when the container apparatus 100 is in the closed position. In the example of FIG. 3A, the locking component 236 is a surface that protrudes outward from the displacement flange 234, and the locking component 336 is a surface that likewise protrudes outward from the displacement flange 334. Thus, when the container apparatus is placed in a closed position, the locking component 236 is received within the interior region of the displacement flange 334 defined by the outward protruding locking component 336 to interlock.

Figure 3B:
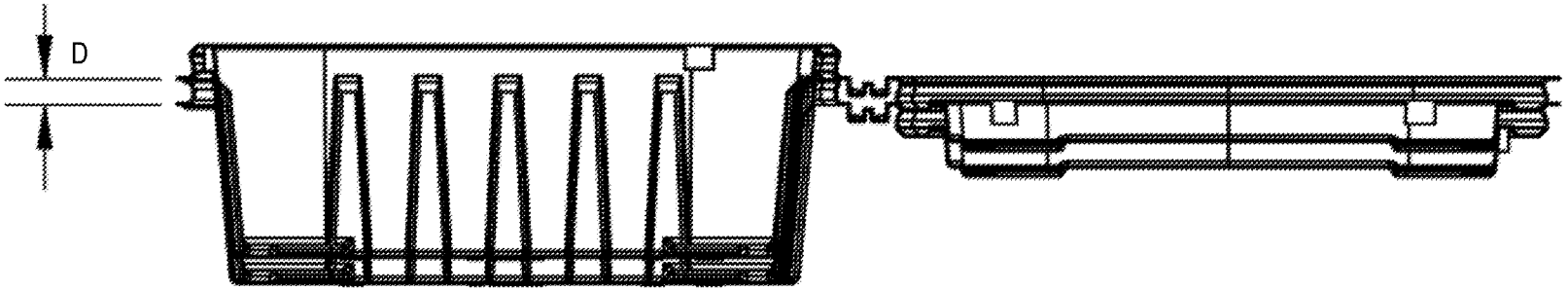
FIG. 3B is a side view of containers in a stacked configuration.

The locking components 336 and 236, combined with the lid volume, also facilitate stacking of multiple containers, as shown in FIG. 3B. When stacked in the open position, the flanges of the containers 100 are separated by a distance D. This distance facilitates the selection of containers by packaging machinery during automated food packing.

Other types of locking components can also be used and in other locations. For example, in FIG. 4, the lid flange 330 and the base flange 230 include respective integrally formed and cooperatively placed locking components 338 and 238 so that the lid section 300 and the base section 200 interlock when the contain apparatus 100 is in the closed position. The locking components 338 and 238 may be cooperatively placed male and female locking components.

The container 100 may be formed out of a variety of appropriate materials. In some implementations, the container 100 is made of polyethylene terephthalate (PET) thermoplastic polymer resin. The container 100 may be clear, or may be opaque. Furthermore, other plastic materials may also be used to form the container 100. Alternatively, a paper product or extruded polystyrene foam maybe used to form the container 100.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A container apparatus, comprising:

a base section, comprising:

a base surface defining a base plane;

base sidewalls extending upward from the base surface to define a base container portion having an upper base periphery extending outward from the base sidewalls, wherein one of the base sidewalls is a front base sidewall, and the front base sidewall extends upward from the base surface to define a base corner on the exterior of the base section; and a base flange projecting outward relative to at least the front base sidewall, wherein the base flange is coupled to the upper base periphery by a base displacement flange that extends downward from the upper base periphery, and the base flange projects outward from the base displacement flange at a position this is below the upper base periphery;

a lid section, comprising:

a lid surface defining a lid plane;

lid sidewalls extending downward from the lid surface to define a lid container portion having a downward lid periphery that extends outward from the lid sidewalls, wherein one of the lid sidewalls is a front lid sidewall; and a lid flange projecting outward relative to at least the front lid sidewall, wherein the lid flange is coupled to the downward lid periphery by a lid displacement flange that extends downward from the downward lid periphery, and the lid flange projects outward from the lid displacement flange at a position this is below the downward lid periphery;

wherein:

the lid displacement flange and the base displacement flange include respective integrally formed and cooperatively placed locking components so that the lid section and the base section interlock when the container apparatus is in the closed position;

when in a closed position the lid flange is below the upper base periphery and the lid flange and the base flange are in juxtaposition and at least one of an outer edge of the base flange or an outer edge of the lid flange defines a flange support surface;

the lid surface is spaced above upper base periphery when in the closed position to define a lid volume from the upper base periphery to the lid surface, and the base section defines a base volume from the upper base periphery to the base surface; and the flange support surface extends outwardly a first distance such that when the combined lid volume and the base volume is loaded with a rated capacity of product and the container apparatus is placed in a standing position on a flat surface using the flange support surface and the base corner as respective support elements, a resulting center of gravity of the container apparatus generates a moment about an axis of the base corner that biases the container apparatus in the standing position, and wherein flange support surface extending outward the first distance causes the container apparatus to rest in the standing positon at a first angle in the range of 70 degrees to 75 degrees measured from the base plane to the flat surface.

2. The container apparatus of claim 1, wherein the base section is flexibly coupled to the lid section along a back base sidewall that is opposite the front base sidewall.

3. The container apparatus of claim 1, wherein the base plane and the lid plane are substantially parallel planes when the container apparatus is in the closed position.

4. The container apparatus of claim 3, wherein a ratio of a height measured from the base surface to the lid surface to a width measured from an interior of the upper base periphery of the front base sidewall to an interior of the upper base periphery of the back base sidewall is approximately 1:2.4.

5. The container apparatus of claim 3, wherein a first ratio of a first height measured from the base surface the upper base periphery to a second height measured from the upper base periphery to the lid surface is approximately 6.7:1.

6. The container apparatus of claim 5, wherein a second ratio of a second height measured from the base surface to the lid surface to a width measured from an interior of the upper base periphery of the front base sidewall to an interior of the upper base periphery of the back base sidewall is approximately 1:2.4.

7. The container apparatus of claim 1, wherein when the container apparatus is in the closed position the lid plane is at second angle measured from the flat surface, and the second angle is greater than the first angle.

8. The container apparatus of claim 1, wherein when the container apparatus is in the closed position the lid plane is at second angle measured from the flat surface, and the second angle is less than the first angle.

9. The container apparatus of claim 1, wherein the flange support surface extends outward to a distance that causes the container apparatus to rest in the standing positon at a first angle in the range of 70 degrees to 75 degrees measure from the base surface to the flat surface.

10. The container apparatus of claim 9, wherein the lid displacement flange and the base displacement flange include respective integrally formed and cooperatively placed locking components so that the lid section and the base section interlock when the container apparatus is in the closed position.

11. The container apparatus of claim 9, wherein the lid flange and the base flange include respective integrally formed and cooperatively placed locking components so that the lid section and the base section interlock when the container apparatus is in the closed position.

12. A container apparatus, comprising:

a base section, comprising:

a base surface defining a base plane;

base sidewalls extending upward from the base surface to define a base container portion having an upper base periphery extending outward from the base sidewalls, wherein one of the base sidewalls is a front base sidewall, and the front base sidewall extends upward from the base surface to define a base corner on the exterior of the base section; and a base flange projecting outward relative to at least the front base sidewall, wherein the base flange is coupled to the upper base periphery by a base displacement flange that extends downward from the upper base periphery, and the base flange projects outward from the base displacement flange at a position this is below the upper base periphery;

a lid section, comprising:

a lid surface defining a lid plane;

lid sidewalls extending downward from the lid surface to define a lid container portion having a downward lid periphery that extends outward from the lid sidewalls, wherein one of the lid sidewalls is a front lid sidewall; and a lid flange projecting outward relative to at least the front lid sidewall, wherein the lid flange is coupled to the downward lid periphery by a lid displacement flange that extends downward from the downward lid periphery, and the lid flange projects outward from the lid displacement flange at a position this is below the downward lid periphery;

wherein:

the lid displacement flange and the base displacement flange include respective integrally formed and cooperatively placed locking components so that the lid section and the base section interlock when the container apparatus is in the closed position;

when in a closed position the lid flange is below the upper base periphery and the lid flange and the base flange are in juxtaposition and at least one of an outer edge of the base flange or an outer edge of the lid flange defines a flange support surface;

the lid surface is spaced above upper base periphery when in the closed position to define a lid volume from the upper base periphery to the lid surface, and the base section defines a base volume from the upper base periphery to the base surface; and the flange support surface extends outwardly a first distance such that when the combined lid volume and the base volume is loaded with a rated capacity of product and the container apparatus is placed in a standing position on a flat surface using the flange support surface and the base corner as respective support elements, a resulting center of gravity of the container apparatus generates a moment about an axis of the base corner that biases the container apparatus in the standing position, wherein the lid flange and the base flange include respective integrally formed and cooperatively placed locking components so that the lid section and the base section interlock when the container apparatus is in the closed position.

13. A container apparatus, comprising:

a base section, comprising:

a base surface defining a base plane;

base sidewalls extending upward from the base surface to define a base container portion having an upper base periphery extending outward from the base sidewalls, wherein one of the base sidewalls is a front base sidewall, and the front base sidewall extends upward from the base surface to define a base corner on the exterior of the base section; and a base flange projecting outward relative to at least the front base sidewall, wherein the base flange is coupled to the upper base periphery by a base displacement flange that extends from the upper base periphery, and the base flange projects outward from the base displacement flange;

a lid section, comprising:

a lid surface defining a lid plane;

lid sidewalls extending downward from the lid surface to define a lid container portion having a downward lid periphery that extends outward from the lid sidewalls, wherein one of the lid sidewalls is a front lid sidewall; and a lid flange projecting outward relative to at least the front lid sidewall, wherein the lid flange is coupled to the downward lid periphery by a lid displacement flange that extends the downward lid periphery, and the lid flange projects outward from the lid displacement flange;

wherein:

the lid displacement flange and the base displacement flange include respective integrally formed and cooperatively placed locking components so that the lid section and the base section interlock when the container apparatus is in the closed position;

when in a closed position the lid flange and the base flange are in juxtaposition and at least one of an outer edge of the base flange or an outer edge of the lid flange defines a flange support surface;

the lid surface is spaced above upper base periphery when in the closed position to define a lid volume from the upper base periphery to the lid surface, and the base section defines a base volume from the upper base periphery to the base surface; and the flange support surface extends outwardly a first distance such that when the combined lid volume and the base volume is loaded with a rated capacity of product and the container apparatus is placed in a standing position on a flat surface using the flange support surface and the base corner as respective support elements, a resulting center of gravity of the container apparatus generates a moment about an axis of the base corner that biases the container apparatus in the standing position;

wherein flange support surface extending outward the first distance causes the container apparatus to rest in the standing positon at a first angle in the range of 70 degrees to 75 degrees measured from the base plane to the flat surface.

* * * * *